United States Patent [19]

Ljungcrantz

[11] 4,258,876

[45] Mar. 31, 1981

[54] RECLOSABLE POUR OPENING STRUCTURE FOR A PACKAGING CONTAINER AND METHOD OF MAKING SAME

[75] Inventor: Billy Ljungcrantz, Châtel-St-Denis, Switzerland

[73] Assignee: Tetra Pak Developpement SA, Lausanne, Switzerland

[21] Appl. No.: 29,875

[22] Filed: Apr. 13, 1979

[30] Foreign Application Priority Data

Apr. 17, 1978 [CH] Switzerland ..... 4092/78

[51] Int. Cl.[3] ..... B65D 5/72; B65D 43/16

[52] U.S. Cl. ..... 229/43; 206/626; 206/633; 220/258; 220/359; 229/7 R

[58] Field of Search ..... 229/17 R, 7 R, 43, 75; 206/626, 633, 621, 622, 631; 220/258, 359

[56] References Cited

U.S. PATENT DOCUMENTS

| | | | |
|---|---|---|---|
| 2,218,670 | 10/1940 | Bennett | 229/17 G |
| 3,039,669 | 6/1962 | Hill | 229/17 R |
| 3,127,082 | 3/1964 | Meyer-Jagenberg | 229/176 X |
| 3,127,085 | 3/1964 | Hill | 229/17 R |
| 3,687,352 | 8/1972 | Kalajian | 229/7 R |
| 3,711,011 | 1/1973 | Kugler | 229/7 R |

*Primary Examiner*—Stephen P. Garbe

*Attorney, Agent, or Firm*—Burns, Doane, Swecker & Mathis

[57] ABSTRACT

An opening structure preferably located in a top panel of a one-way packaging container provides a pour opening which can be reclosed after the initial opening. The structure is prepared by positioning and sewing a portion of a strip of web material on the panel, defining a pour opening area within the secured strip portion by applying a cut or weakening line forming a boundary. The pour opening area of the panel is retained in its original position in the panel. Then a second, unsecured portion of the strip is folded back over the first portion to cover the first portion and the pour opening area. Securing zones are produced to secure the second strip portion to the panel both within the pour opening area and a surrounding region to thereby obtain a hermetically sealed opening structure on the packaging container. The pour opening is uncovered by lifting the second strip portion so that the cut-out section of the panel is removed. After the desired quantity of the contents of the container has been discharged, the second strip portion and the cut-out section of the panel attached thereto is folded back over the pour opening so that snap-action engagement of the edges of the cut-out panel section with the edges of the pour opening results in a closure which, although no longer hermetically sealed, is mechanically secured.

3 Claims, 6 Drawing Figures

RECLOSABLE POUR OPENING STRUCTURE FOR A PACKAGING CONTAINER AND METHOD OF MAKING SAME

BACKGROUND OF THE INVENTION

1. Field of the Invention

This invention relates to a reclosable pour opening structure for a packaging container and, more particularly, to an opening structure comprising a panel section enclosed by an opening boundary line on the panel which panel section is removable from the panel to provide a pour opening therein, and further comprising a cover foil overlying the removable panel section and liftable from the panel in the region of the opening boundary line, the cover foil being connected through an inseparable union both with the panel at a junction situated outside the opening boundary line and with the removable panel section, so that lifting of the cover foil will cause the removable panel section to be lifted and lowering the cover foil to its original position will cause the removable panel section to reenter the pour opening to reclose it. The invention also relates to a method of making such an opening structure.

An opening structure of one-way packages should meet the following requirements:

(1) Permit easy opening and reclosing;

(2) Permit hygienic and non-splashing pouring of the contents from the packaging container;

(3) Not cause accumulation of dirt during shipping and storing of the packaging container;

(4) Be simple and inexpensive to produce;

(5) Require little space;

(6) Upon opening, no part of the opening structure should be detached from the packaging container.

SUMMARY OF THE PRIOR ART:

Exemplary embodiments of opening structures of the above-defined kind are shown in U.S. Pat. Nos. 3,133,689 and 3,438,565. In these prior art opening structures the cover foil is made of the same material as the panel of the packaging container; in fact, it is integral with the panel. The thickness of the cover foil thus is always equal to the thickness of the panel material, and if the panel material has a considerable thickness, the opening structure may therefore be undesirably bulky. Moreover, the strength of the inseparable union of the cover foil with the panel is dependent on the strength of the panel material. Although this union could be designated as "inseparable" in the sense contemplated in this application, because it is not intended, and indeed not very easily possible, to detach the cover foil completely from the panel when the opening operation is carried out, a complete tearing off of the cover foil from the panel may not always be avoided.

SUMMARY OF THE INVENTION

It is an important object of the invention to provide an opening structure which meets these requirements in an advantageous manner and to render possible the production of the opening structure in a simple and inexpensive manner without waste of material.

In the opening structure according to the invention, the cover foil and an additional inner foil which constitutes an important element of the invention, may be made from a material different from that of the panel of the packaging container. It has been found that it is sufficient that the inner foil is capable of being inseparably united with the panel. Thus, in other words, the careful selection of the panel material need not be taken into consideration. This freedom of choice is important, because it permits the cover foil and the inner foil to be made of a material that is very thin and yet has sufficient strength and characteristics which meet other requirements of an opening structure. These requirements may be different from the requirements that the panels of the packaging containers have to meet.

The method according to the invention permits a simple and economic production of the opening structure without requiring extra panel material or generating scrap material. The only additional material required is the material from which the cover foil and the inner foil are made. Preferably, the cover foil and the inner foil are formed from a single foil strip which can advantageously be supplied from a continuous web, the width of which is equal to the length or the width of the foil strip, the foil strip being cut off from the web in the course of the production of the opening structure.

The above and other objects and advantages of the present invention will become apparent upon reading the following specification and referring to the accompanying drawing which forms part of this disclosure.

The invention consists in the features of construction, combinations of elements and steps, and arrangements of parts, which will be exemplified in the construction hereinafter described, and of which the scope will be indicated by the appended claims.

Figure 3:
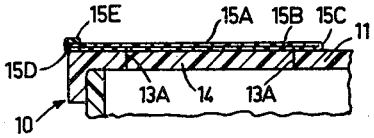
FIG. 3 is a cross-sectional view on line III—III of FIG. 2.
Figure 4:
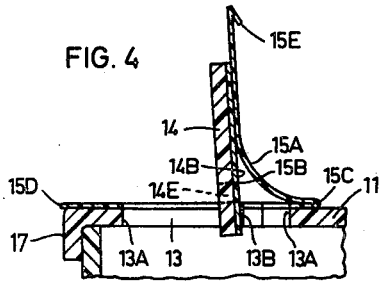
FIG. 4 is a cross-sectional view similar to FIG. 3 but showing the opening structure in an opened position.

In the cross-sectional views of FIGS. 3 and 4 the thickness dimensions are heavily exaggerated in the interest of clarity.

DESCRIPTION OF THE PREFERRED EMBODIMENT

Figure 1:
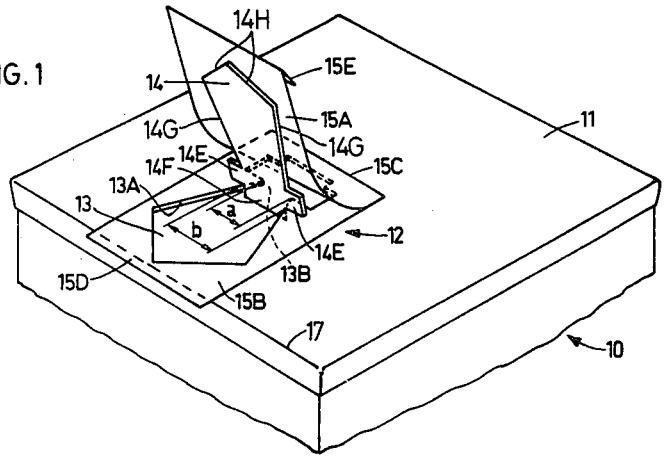
FIG. 1 is a perspective view of the top portion of a packaging container showing the top panel of the container and an opening structure according to the invention provided in the top panel, the opening structure being shown in an opened position.
Figure 2:
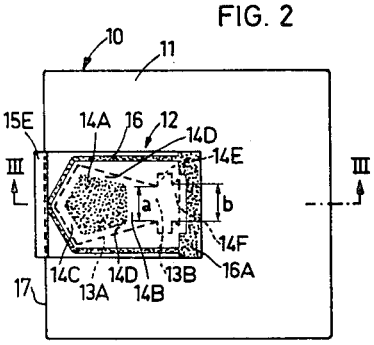
FIG. 2 is a plan view of the packaging container of FIG. 1, the opening structure being shown in unopened or reclosed position.

The packaging container 10 shown in FIGS. 1 to 4 is in the shape of a parallelepiped and is intended for a liquid product. The top panel 11 of the container is flat and incorporates an opening structure 12 constructed and produced in accordance with the invention. FIG. 1 shows the opening structure in an opened position. By means of this opening structure, a pour opening 13 can be provided which permits an unobstructed pouring of the liquid product. Initially, the opening structure 12 is hermetically closed or sealed, as shown in FIG. 2. After the initial opening thereof, the opening structure may be reclosed so as to prevent splashing or contamination of the product through the pour opening. Naturally, the reclosing does not result in a hermetic seal, but as will become apparent from the ensuing description, the opening structure can be reclosed fairly tightly.

The packaging container 10 preferably is made from a multilayered relatively rigid sheet material which may comprise a thick central carrier layer of expanded plastic coated on both sides with thin layers of homogenous plastic. However, the opening structure according to the invention is not restricted to packaging containers made of such material, but has a more general applicability.

The opening structure 12 comprises a section 14 cut out from the top panel 11 and congruent with the pour opening 13, a cover foil 15A inseparably united with the cut-out section 14, and an inner foil 15B inseparably united with the panel 11. The cover foil 15A and the inner foil 15B are each formed by a segment of a plastic foil strip 15 folded back on itself about a transverse fold line 15C. As shown in FIGS. 1 and 4, the pour opening 13 extends both through the panel 11 and through the inner foil 15B. A front-end portion 15D of the inner foil 15B projects slightly past the adjacent edge 17 of the top panel.

The cover foil 15A is united with the panel section 14 only within a zone situated inwardly of the end portion 15D of the foil strip 15. This zone is designated 14A in FIG. 2 and marked by dotted shading. Within a zone 14B situated inwardly or rearwardly of the zone 14A, i.e. nearer the fold line 15C, the cover foil 15A is not united with the cut-out panel section 14. As likewise shown in FIG. 2, non-united marginal zones 14C and 14D are also provided between the zone 14A, on the one hand, and the angled front edge 14H and the two lateral edges 14G (FIG. 1) of the panel section 14, on the other hand. Thus, within these marginal zones, the panel section 14 and the inner foil portion overlying it may flex resiliently towards and away from the cover foil 15A. This flexibility is especially advantageous in respect of the marginal zone 14C.

Except for the non-united end portion 15D, the inner foil 15B is inseparably united throughout the entire area thereof with the top panel 11. The section of the inner foil 15B covering the cut-out panel portion 14 thus is inseparably united with the panel portion throughout the entire area thereof and comprises the dotted zone 14A in which the panel section 14 is inseparably united, through the intermediary of the inner foil 15B, with the cover foil 15A.

From FIG. 2, in which a dotted line shows the boundary 13A of the pour opening 13, the cut-out panel section 14 covering it, and the portion of the inner foil 15B which is congruent with and overlies the panel section 14, it is seen that in the rear portion thereof the pour opening 13 has a throat 13B, the width of which is designated a. From FIG. 2 it is also seen that the panel section 14 has a corresponding waist and laterally projecting tabs 14E disposed rearwardly of this waist. The end portion 14F adjoining the tabs 14E is dove-tailed in shape, and the width b of its narrowest part is only slightly, e.g. 0.5–1 mm, larger than the width a of the throat 13B.

In its initial, hermetically closed or sealed condition, the opening structure 12 comprises a separable, i.e. tear open union between the cover foil 15A and the inner foil 15B which union extends about the opening boundary line 13A and the panel section 14. As shown in FIG. 2, this union is provided in a zone 16 forming a closed loop and marked by dot shading. Outside the zone 16 there is thus no union between the cover foil 15A and the inner foil 15B, although the cover foil overlies and completely covers the inner foil. The union in the zone 16 may be separated fairly easily by lifting the cover foil 15A. The front end portion 15E of the cover foil 15A is folded over 180 degrees to form a grip tab facilitating the lifting of the cover foil.

When the opening structure 12 is to be opened for the first time, the grip tab formed by the folded-over end portion 15E is gripped between the fingers and pulled upwardly and rearwardly. The lifting causes the union in the zone 16 to be torn open gradually, and at the same time the panel section 14 is lifted such that the pour opening 13 is uncovered. When the union has been torn open up to the fold line 15C, or at least up to the vicinity of the fold line, the flexing and consequent curving of the cover foil 15A has caused the rear portion 14B of the panel section 14 to move forwardly from the cover foil. If the cover foil is then released, the end portion 14F of the panel section 14 will drop into the pour opening 13 adjacent but forwardly of the throat 13B so that the laterally projecting pull tabs 14E of the panel section 14 are engaged with the top surface of the panel 11 to retain the panel section 14 and the cover foil 15A in open position, see FIGS. 1 and 4.

Reclosing of the panel section 14 and the cover foil 15A is effected by pressing the cover foil 15A forwardly and downwardly by a finger. The end portion 14F will then be pressed rearwardly through the throat 13B and enter the area of the pour opening 13 situated rearwardly of the throat. This can be done without damaging the panel 11 or the panel section 14, because the material of the panel 11 and the panel section 14 possesses a certain degree of elasticity and because the width a of the throat 13B is only slightly smaller than the width b of the end portion 14F. As the downward movement of the cover foil 15A towards the panel 11 continues, the panel section 14 is reinserted in the pour opening to resume its original position as shown in FIG. 3.

In this position, in which the cover foil 15A again covers the inner foil 15B, the edges of the panel section 14 snugly engage the edges of the pour opening and this engagement is sufficient to retain the panel section in the pour opening during normal manipulation of the packaging container 10. Since the cutting out of the panel section 14 from the panel 11 was effected without removing any material, a kind of snap-action engagement of the panel section 14 with the adjacent portions of the panel 11 is obtained. If the opening structure 12 is to be opened and reclosed again, the cover foil 15A is first lifted as described and then again folded down towards the panel 11. Both upon the initial opening and repeated opening, the lifting of the panel section 14 from the pour opening is facilitated by the flexing of the foremost portion of the panel section 14 at the non-united marginal zone 14C.

The opening structure 12 is primarily intended for one-way packaging containers. It is sufficient for it, therefore, to endure relatively few opening and reclosing operations before the ability of the tabs 14E and the end portion 14F to retain the opening structure in open position, or the ability of the panel section 14 to snugly engage the edges of the pour opening is lost.

As shown in FIG. 2 the closed-loop zone 16 in which the cover foil 15A has a separable union with the inner foil 15B also comprises a section 16A which extends across the width of the foil and is situated adjacent the fold line 15C. Normally, the union is not torn open in this section. The length of the portion of the cover foil 15A which curves upon the lifting (FIG. 4) therefore is relatively short, although the cover foil extends a relatively long distance past the rear end of the pour opening, as is desired. Even if the cover foil is fairly thin, it can thus possess sufficient stability in the portion thereof which is curved.

However, if the union should happen to be separated up to the fold line 15C, the consequences will not be serious, because the cover foil always remains inseparably united with the inner foil 15B and thus with the panel 11 along the fold line 15C. It is therefore possible to omit the union in the section 16A, provided of course that the lateral limbs of the zone 16 extend up to the fold line 15C.

Figure 5:
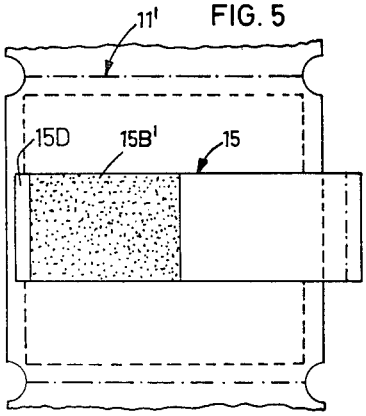
FIG. 5 is a plan view illustrating the first step of the production of the opening structure.
Figure 6:
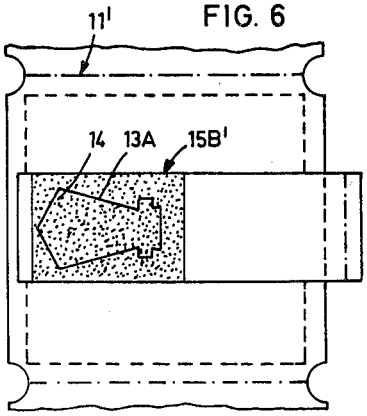
FIG. 6 is a view similar to FIG. 5 and showing the next step of the production.

FIGS. 5 and 6 show two initial steps of the production of the opening structure 12. These steps preferably are carried out simultaneously with the production of the blank from which the top panel 11 of the packaging container 10 is made. Such a blank, which may be a segment of a continuous web, is shown in FIGS. 5 and 6 in which it is designated 11'.

The first step comprises applying the foil strip 15 on the top surface of the blank 11' as shown in FIG. 5 and uniting it inseparably with the blank in the area 15B' marked by dot shading. The area 15B' corresponds to the area which in the finished opening structure is covered by the inner foil 15B, except for the free end portion 15D.

The second step comprises cutting through the panel blank 11' and the foil strip 15 throughout the opening boundary line 13A so that the panel section 14 is completely severed from the remaining portion of the blank through the cut. However, the panel section 14 is retained in its initial position in the blank or is returned to such position.

After the panel section 14 has been cut out, the foil strip 15 is folded over upon itself along the fold line 15C so that it covers the united area 15B' and the end portion 15D. The end portion 15E forming the grip tab may be folded over at the same time or immediately thereafter. Then, the zones 14A, 16 and 16A in which the folded-over foil segment forming the cover foil 15A is united with the already secured foil segment forming the inner foil 15E are produced. If the end portion 15B has not yet been folded over, the folding over is effected as a final step.

After the panel blank 11' with the now finished opening structure 12 has been severed from the blank web, it can be applied to one end of a container body and secured thereto after the marginal portions have been turned down about the folding lines indicated by broken lines in FIG. 5.

The unions between the cover foil 15A and the inner foil 15B and between the inner foil 15B and the panel 11 preferably are produced by heat sealing. It will be appreciated, however, that adhesive joints and other types of joints may also be used. The unions (at 14A, 15B') which have been termed inseparable may be produced in the same way as the union (at 16, 16A) which has been termed separable, provided that the former unions can be made firm enough, by suitable dimensioning or by other means, to meet the requirements for mechanical strength applied in the present case. These requirements have to be met both during normal (i.e. not exceedingly careless) handling of the package and during manipulation of the opening structure.

Naturally, the strip 15 has to be relatively thin in order that the combined thickness of the panel 11 and the opening structure may not be unduly large. Too large a thickness is disadvantageous particularly when the panel blanks with the finished opening structure 12 thereon are stacked. However, the strip must also have sufficient strength in order that it may not easily be torn off at the folding line 15C if the opening structure is opened in a careless manner. Moreover, the strip has to meet hygienic requirements, at least in the case of food or beverage packages. It should also be water repellent and of course must permit the required unions to be produced. These requirements are met by the materials customarily used for conventional opening structures, such as polyvinylchloride. Thus, the invention can be practiced using existing and well-tried means.

Various modifications are possible without departing from the scope of the invention. For example, the opening boundary line enclosing the removable panel section 14 may be formed by an intermittent cut line or a weakening line along which the panel 11 and the inner foil 15B are severed when the cover foil 15A is lifted for the first time. In the case of the opening boundary line being formed by a weakening line, i.e. in the case of a panel which for practical purposes may be considered to be fluid-tight even at the removable panel section until the first opening takes place, the separable union between the cover foil and the inner foil which extends about the removable panel section need not be hermetically sealed. It is sufficient for it to be able to prevent entry of dirt between the foils and to retain the cover foil in the folded-down position reliably enough to prevent unintentional opening.

The removable panel section 14 of course may have a shape different from that shown. If the cover foil 15A is able by itself to remain in the opened position, the support tabs 14E of the panel section 14 and the throat 13B of the pour opening 13 may be omitted so that the panel section and the pour opening may be given a simpler shape.

What is claimed is:

1. In a panel of a packaging container a reclosable pour opening structure, comprising an inner foil overlying an area of the panel and inseparably united with the panel over substantially the entire of said area, a removable section provided within said area and comprising congruent panel and inner foil sections enclosed by an opening boundary line on the panel, said removable section being removable from the panel to provide a pour opening therein defined by the opening boundary line and being further comprised of a terminal portion and laterally projecting support tabs wherein the opening boundary line defines a throat in the pour opening, the width of the throat being smaller than the width of said terminal portion, and a cover foil overlying the inner foil and being inseparably united with the inner foil within at least a portion of the zone enclosed by the opening boundary line and at a junction situated outside said zone, said inner foil and cover foil being devoid of union in the zone which is situated adjacent said junction, said cover foil being liftable from the inner foil outside of the zone, whereby lifting of the cover foil will cause the removable section to be lifted to a lifted position wherein the terminal portion of the removable sections enters the pour opening on the side of the throat remote from said junction and is supported by said support tabs on the top side of the panel adjacent the throat and lowering the cover foil to its original position will cause the terminal portion to be displaced through the throat into the region of the pour opening situated on the other side of the throat and will cause the removable section to reenter the pour opening to reclose it.

2. Opening structure according to claim 1 in which the cover foil and the inner foil are each formed by a segment of a single integral foil strip which is folded over on itself about a transverse fold line forming said junction.

3. Opening structure according to claim 1 in which the opening boundary line is formed by a cut extending through both the panel and the inner foil and in that the cover foil is sealingly united through a tear open seal with the inner foil outside the opening boundary line.

* * * * *